United States Patent [19]

Fellner

[11] Patent Number: 5,018,283

[45] Date of Patent: May 28, 1991

[54] LOADER BUCKET TOOTH

[75] Inventor: Ronald W. Fellner, Dubuque, Iowa

[73] Assignee: Deere & Company, Moline, Ill.

[21] Appl. No.: 570,485

[22] Filed: Aug. 21, 1990

Related U.S. Application Data

[63] Continuation-in-part of Ser. No. 389,655, Aug. 4, 1989, Pat. No. 4,949,481.

[51] Int. Cl.[5] ..... D06F 79/00

[52] U.S. Cl. ..... 37/141 T; 37/142 R; D15/29

[58] Field of Search ..... 37/141 T, 141 R, 142 R, 37/142 A; 172/713; D15/29

[56] References Cited

U.S. PATENT DOCUMENTS

| | | |
|---|---|---|
| D. 284,010 | 5/1986 | Voyce . |
| 3,121,289 | 2/1964 | Eyolfson . |
| 3,312,504 | 4/1967 | Makinen . |
| 3,729,845 | 5/1973 | Flippin . |
| 3,959,901 | 6/1976 | Klett . |
| 4,123,861 | 11/1978 | Hemphill . |
| 4,136,469 | 1/1979 | Zepf . |
| 4,231,173 | 11/1980 | Davis . |
| 4,251,933 | 2/1981 | Hemphill . |
| 4,321,762 | 3/1982 | Hemphill . |
| 4,324,057 | 4/1982 | White . |
| 4,470,210 | 9/1984 | Hahn . |
| 4,616,433 | 10/1986 | Knell et al. . |
| 4,642,920 | 2/1987 | Lenhoff . |
| 4,748,754 | 6/1988 | Schwappach . |
| 4,761,900 | 8/1988 | Emrich . |

OTHER PUBLICATIONS

John Deere Parts Catolog; pp. 65 and 67.

John Deere Operator's Manual for John Deere 310C Backhoe Loader, p. 39.

*Primary Examiner*—Dennis L. Taylor

*Assistant Examiner*—J. Russell McBee

[57] ABSTRACT

A digging tooth for a loader bucket comprising a top surface having a concave configuration and a bottom surface having a flat forward portion and a convex rear portion. The flat forward portion and the top surface intersect to form a forward cutting edge. Sidewalls connect the two surfaces and are concave having a plowshare shaped. The rear portion of the tooth is provided with a mounting assembly for mounting it to a bucket. The bottom surface continuously converges from the forward cutting edge to the rear portion; whereas the top surface first converges than diverges from the forward cutting edge to the rear portion.

1 Claim, 1 Drawing Sheet

FIG. 1
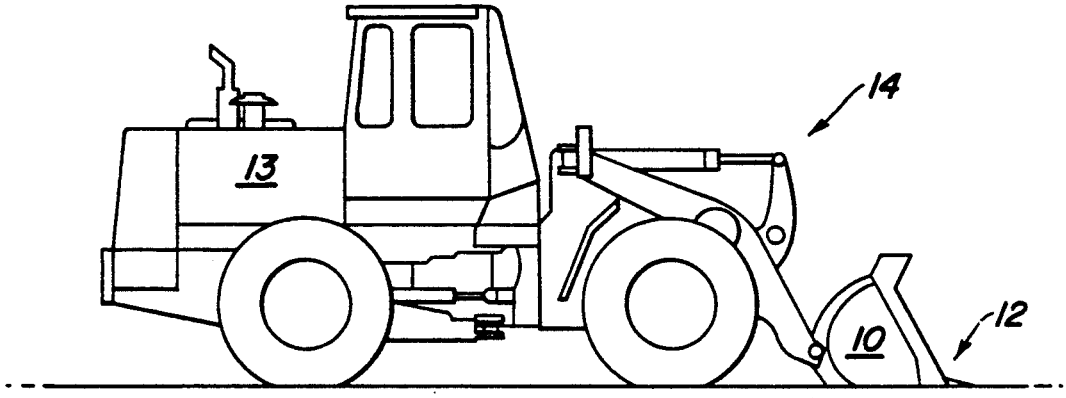
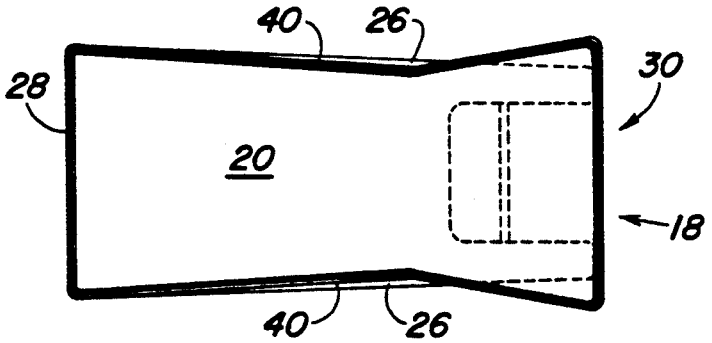
FIG. 2
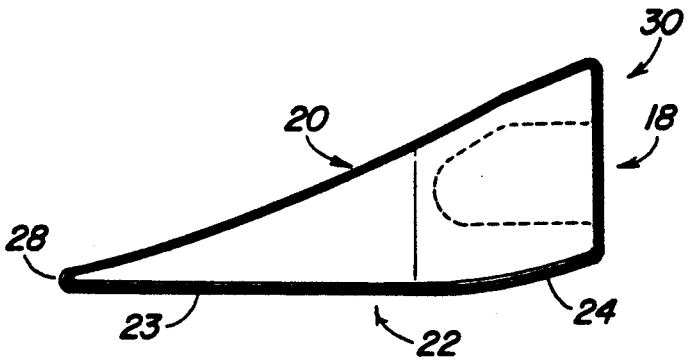
FIG. 3
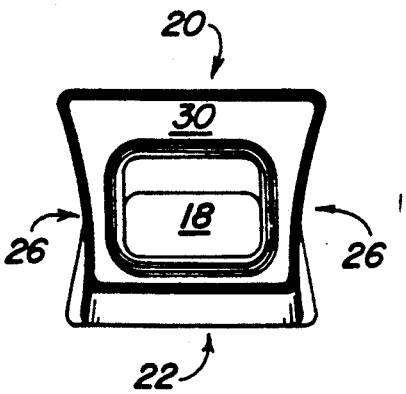
FIG. 4

LOADER BUCKET TOOTH

This application is a Continuation-In-Part of application Ser. No. 389,655, filed Aug. 4, 1989, now U.S. Pat. No. 4,949,481, which issues on 21 Aug. 1990.

BACKGROUND OF THE INVENTION

1. Field of the Invention:

The invention is directed to improved digging teeth for loader buckets.

2. Description of the Prior Art:

Modern backhoes and excavators are designed to move a bucket through an arcuate path when digging. In addition the cutting angle of the bucket can be adjusted by manipulating the bucket hydraulic cylinder during a digging operation. Bucket teeth maybe added to the bucket to aid in the digging operation.

Traditionally digging teeth have a wedge shaped configuration. However over the years many different configurations of digging teeth have been proposed. U.S. Pat. No. 4,642,920 discloses digging teeth having a wedge-shaped configuration and concave sides sidewalls. U.S. Pat. No. 4,321,762 discloses digging teeth having sloped sidewalls. U.S. Pat. Nos. 4,123,861, 4,251,933 and 4,470,210, and U.S. Pat. No. 284,010 disclose other digging teeth configurations. Of particular interest is U.S. Pat. No. 4,949,481, assigned to the assignee of the present invention.

SUMMARY

It is an object of the present invention to provide a digging tooth configuration that more easily moves through material thereby increasing the efficiency of the digging bucket to which it is attached.

The digging tooth of the present invention comprises a top surface having a concave configuration and a bottom surface having a forward flat portion and a rear convex portion. The concave top surface and the flat bottom portion intersect to form a forward cutting edge. The concave top provides a downward force on the tooth and loader bucket as it is being moved though material horizontally. The convex portion of the bottom surface provides material relief when the bucket is being tilted upwardly. The flat portion of the bottom surface provides a level horizontal surface for keeping the bucket in a level configuration. Both sidewalls of the cutting tooth have a concave or plowshare shaped. The top surface as defined by the top-side edges formed by the sidewalls with the top surface is hourglass shaped. More specifically, proceeding from the forward cutting edge to the rear portion of the digging tooth, the top-side edges initially converge and then diverge.

The bottom surface as defined by the bottom-side edges formed by the sidewalls with the bottom surface continuously converge as they proceed from the forward cutting edge to the rear portion of the digging tooth.

BRIEF DESCRIPTION OF THE DRAWINGS

FIG. 1 is a side view of a loader having a bucket provided with the digging teeth of the present invention.

FIG. 2 is a top view of the digging tooth.

FIG. 3 is a side view of the digging tooth.

FIG. 4 is a rear view of the digging tooth.

DETAILED DESCRIPTION

Loader bucket 10, illustrated in FIG. 1, is provided with a plurality of cutting teeth 12. Bucket 10 is operatively secured to loader 13 by linkage 14. The forward edge of the loader bucket is provided with tooth receiving shanks to which the cutting teeth are mounted. Cutting teeth 12 are secured to the bucket in a conventional manner. The tooth is provided with a shank receiving cavity 18 located at the rear of the tooth. In mounting the tooth to the bucket, the tooth is mounted over the mounting shank projecting from the bucket.

The bucket tooth is best illustrated in FIGS. 2–4. The tooth is provided with a top surface 20 having a concave configuration, a bottom surface 22 having a flat portion 23 and a convex portion 24, and two concave sidewalls 26. The top concave surface and the flat bottom surface portion intersect to form forward cutting edge 28. Rear portion 30 of the tooth is provided with mounting means for mounting the tooth to the bucket. The mounting means comprises shank receiving cavity 18.

As illustrated in FIG. 1, the flat bottom portion of the bottom surface is located below the floor of the loader bucket. The convex surface allows the bucket to be more easily tilted rather than an abrupt angle. Top surface 20 is also hourglass shaped as defined by top-side edges 40 formed by top surface 20 with sidewalls 26, respectively. Proceeding from the forward cutting edge to the rear portion of the digging tooth, the top surface first converges then diverges creating the hourglass shape. The concave top surface provides downward pressure on the tooth so that the bucket is more easily maintained in a horizontal condition when passing through material.

The flat bottom surface portion provides a level horizontal base for the tooth further assisting in the horizontal level movement of the bucket. The flat bottom surface is flared outwardly at the cutting edge and continually converges from the cutting edge to the rear of the tooth.

Sidewalls 26 extending between the top surface and the bottom surface are plowshare shaped defining concave surfaces.

The above described digging tooth should not be limited by the above described embodiment but should be limited solely by the claims that follow.

I claim:

1. A digging tooth for a loader bucket, comprising a top surface having a concave configuration;

a bottom surface having a flat forward portion and a convex rear portion , the flat forward portion intersecting the top surface to form a forward cutting edge;

two plowshare sidewalls extending between the top surface and the bottom surface; and a rear portion extending between the concave top surface, the convex bottom surface and the two sidewalls, the rear portion being provided with mounting means for mounting said digging tooth on a digging bucket, wherein the top surface proceeding from the forward cutting edge to the rear portion first converges then diverges, and the bottom surface proceeding from the forward cutting edge to the rear portion continuously converges.

* * * * *